US005804056A

United States Patent [19]

Pempera et al.

[11] Patent Number: 5,804,056

[45] Date of Patent: Sep. 8, 1998

[54] PROCESS AND APPARATUS FOR PRODUCING STRIP PRODUCTS FROM STAINLESS STEEL

[75] Inventors: Franz Gerhard Pempera, Neuwied; Michael Haentjes, Essen; Andreas Jaenichen, Düsseldorf; Rainer Kilb, Düsseldorf; Horst Edel, Düsseldorf; Jürgen Flügge, Duisburg, all of Germany

[73] Assignee: Mannesmann Aktiengesellschaft, Düsseldorf, Germany

[21] Appl. No.: 715,394

[22] Filed: Sep. 13, 1996

[30] Foreign Application Priority Data

Sep. 15, 1995 [DE] Germany ..... 195 35 844.9
Sep. 26, 1995 [DE] Germany ..... 195 37 501.7

[51] Int. Cl.[6] ..... C25F 1/06; C25F 7/00

[52] U.S. Cl. ..... 205/661; 205/709; 205/710; 204/209; 204/211

[58] Field of Search ..... 205/640, 660, 205/661, 709, 710; 204/206, 207, 209, 211

[56] References Cited

U.S. PATENT DOCUMENTS 3,338,809 8/1967 Stricker ..... 205/710
5,022,971 6/1991 Maresch et al. ..... 205/710
5,382,335 1/1995 Jirenec et al. ..... 204/144.5
5,472,579 12/1995 Maruchi et al. ..... 205/709

FOREIGN PATENT DOCUMENTS 0 235 595 9/1987 European Pat. Off. ..... C25F 1/00
0 367 112 5/1990 European Pat. Off. ..... C25F 1/06
0 518 850 A1 12/1992 European Pat. Off. ..... C25F 7/00
0 664 276 A1 3/1995 European Pat. Off. ..... C25F 1/06
353116231 10/1978 Japan ..... 205/709

*Primary Examiner*—Donald R. Valentine
*Attorney, Agent, or Firm*—Cohen, Pontani, Lieberman & Pavane

[57] ABSTRACT

A process and apparatus for the continuous treatment of annealed and non-annealed hot strip of stainless steel. First, the hot strip is stretched, bent and straightened to break a scale which has grown on the hot strip. Then, a electrolytic pickling is performed in an electrolyte with multiple alternating anodically-connected and cathodically-connected strip polarization. Directly following thereafter, pickling once again takes place in the electrolyte with multiple anodically-connected electrodes arranged directly behind one another and corresponding cathodic strip polarization, followed by anodic strip polarization produced by means of a cathodically-connected electrode. To further remove any scale remaining on the surface of the hot strip, the hot strip is subject to high-pressure fluid spraying or brush aggregates. Renewed electrolytic pickling in performed with at least one electrolyte with multiple exclusively cathodically-connected electrodes and anodic strip polarization. Finally, post-treatments are performed such as washing, brushing, post-washing and drying of the strip surface.

17 Claims, 1 Drawing Sheet

PROCESS AND APPARATUS FOR PRODUCING STRIP PRODUCTS FROM STAINLESS STEEL

BACKGROUND OF THE INVENTION

1. Field of the Invention

The present invention relates to a process and a device for the continuous treatment of annealed and non-annealed hot strips of stainless steel, particularly with high alloy shares of chrome of the AISI Series 300 and 400, in a descaling unit.

2. Description of the Related Art

In the manufacture of products from stainless steel, especially strip products with high alloy shares of chrome of the AISI Series 300 and 400, heat treatments play a crucial role in forming the products and establishing the crystalline microstructure. During these thermal treatments, which can reach temperatures of over approximately 1,200° C. in individual production steps, oxidation processes, also known as "scaling processes", are unavoidable, because, for reasons related to production and process, it is not possible for the treatments to be carried out in an oxygen-free atmosphere.

During production, oxide layers which build up on the surface of the steel strip during the scaling processes must be repeatedly removed. Oxide layers are extremely undesirable and obstructive in subsequent production steps, especially in rolling processes. In addition, even the slightest amount of residual scale remaining on the surface of the steel strip makes it impossible to achieve desired surface qualities of the steel during production.

Removing scale layers from stainless steel places special demands on the technology and methods used in the production of high-quality steel products, in light of the fact that steel surfaces are corrosion-resistant. "Corrosion-resistant" means that a material exchange with the surrounding phase, typically air, results in reaction products, e.g. "rust", that only develop very slowly on the stainless steel surface. One reason for this is that stainless steels form passive layers, preferably in oxidating acids, but also under normal atmospheric conditions, i.e. in the air. These passive layers are characterized by an extremely low level of disorder, so that diffusion processes (material exchange via ion transport) occur in a very retarded fashion and, as a result, only very slow layer growth is possible. These passive layers of stainless steels, which are very efficient relative to corrosion behavior, consist of oxide and hydroxide layers in various mixed crystal forms with a thickness of only several atomic layers (approximately 1 to 20 nm), contain only small amounts of the element iron and consist largely of chemically highly-stable oxygen compounds of chrome ($Cr_2O_3$), the alloy element characteristic of the steels of interest. The element chrome, as a steel alloy, plays a special role in individual scaling processes over the course of production and thus in the methods to remove the scale layers, as discussed further below.

Along with the corrosion-resistance and mechanical properties of high-quality steels, the surface quality of a noble steel product—in technical terms, its roughness—is very significant to the spectrum of use for such products. Along with purely material parameters, corrosion-resistance and surface quality are the most important characteristics of noble steel products.

Strip products from stainless steel are subjected during manufacture to rolling processes, in the course of which the strip is rolled out to greater lengths—and therefore to larger surfaces—while undergoing forced reduction in strip thickness. There are two different types of rolling processes, hot rolling processes and cold rolling processes.

When the starting material for the rolling process, e.g. the slab, is heated to a temperature of approximately 1,250° C., the product that results is called hot strip. When the steel strip is subjected to a rolling process at room temperature, however, the resulting product is known as cold strip. Hot strip generally involves larger strip thicknesses, while cold strip, by its nature, involves smaller strip thicknesses relative thereto. The thickness ranges of individual product lines can overlap to a greater or lesser extent.

Beginning with steelmaking products in the form of slabs, first, hot rolling passes are carried out, sometimes repeatedly. Then, beginning from a certain strip thickness, cold strip with the desired strip thickness and surface quality is produced in finishing cold passes. Preferably, this is done in serial sequence. The thermal conditions during the forming hot passes lead, under prevailing conditions, to the undesirable formation of marked scale layers on the steel surfaces and crystal structures and microstructures in the steel basic matrix.

A thermal treatment of annealing the hot strip is intended to create, by conversion, a completely recrystallized microstructure from austenitic stainless steel of AISI Series 300. The hot strip has elongated, non-recrystallized grains in its center and, in part, over its entire cross-section, because the high alloy share retards recrystallization to such an extent that it can occur only partially during the rolling process and the cooling in coil which follows. In the ferritic stainless steels of AISI Series 400, the annealing process achieves, along with recrystallization, spheroidization of the martensitic microstructure (precipitation of solute carbon in the form of spherical carbides and breakdown of high dislocation density) that has formed during the cooling process, following the rolling process. Spheroidization is not necessary for stabilized ferritic steels of AISI 409 and 439, for example, which have a ferritic microstructure in the rolling state (the carbon is bound in stable fashion in the form of titanium carbide TiC).

The annealing process is necessary to produce the desired crystal structure and microstructure of the steel. In order to attain continuous ferritic or austenitic microstructures, material temperatures of approximately 800° to 900° C. for ferrites and up to approximately 1,200° C. for austenites must be reached. This leads to further scaling on the steel surfaces. By means of suitable process methods, it is possible, within limits, to influence this oxide formation in respect to quality as well as quantity, as discussed further below.

Scale that forms on steel surfaces during hot rolling is referred to as rolling scale, while scale that forms on steel surfaces during the aforementioned annealing process is known as annealing scale. These two types of scale differ in their characteristics. Such differences originate in the starting and border conditions during scale development, which are discussed in greater detail below.

During the production of strip steel, particularly stainless steel with a high chrome share of AISI Series 300 and 400, because of the scaling process, repeatedly the scale layers must be completely removed in a subsequent process step in order to prepare the strip for any further rolling processes and bring the strip, and thus the strip surface, to the expected quality level. The formation of scale on surfaces of stainless steel with a high chrome share is complex and depends on a series of different parameters and conditions. Scale formation is based in principle on the following mechanism:

When iron is exposed to an oxidating atmosphere, then, depending on the temperature range and oxygen pressure, differently composed layers of the oxides wustite (FeO), magnetite ($FeO_4$) and/or haematite ($Fe_2O_3$) are formed. It is possible to predict in advance, based on thermodynamic laws and data, which oxide will be in stable equilibrium with the gas phase and what the layer sequence of the oxidation products will be. The growth of the oxide layers is determined initially by surface reactions and is linearally time-dependent. When the oxide layer becomes thicker, diffusion processes in the oxides are rate-determinant, and the parabolic time law applies. Diffusion in the oxides is made possible by disorder in the ion lattice, empty spaces or interlattice atoms. Oxides with low disorder, which form a closed oxide layer, grow slowly and protect against high-temperature corrosion. Protective oxide layers are formed by the alloy elements chrome, aluminum and silicon.

When noble steel alloys with a chrome share of more than roughly 15.5% are annealed at temperatures of up to 1,200° C. in atmospheres with a sufficient free oxygen share, a stable and continuous mixed oxide layer $(Cr,Fe)_2O_3$ spontaneously forms at the border area of the gas phase and the metal phase. This continuous layer constitutes a diffusion barrier for the oxygen of the gas phase and the elements of the steel alloy, largely preventing further oxidation of the underlying alloy elements of the steel. At the same time that this mixed oxide layer forms on the surface of the metal matrix, the metal matrix is depleted of chrome in its depth.

The formation of the mixed oxide layer on the metal surface and the associated simultaneous chrome depletion of the underlying metal matrix is due to the high affinity of the chrome to combine with oxygen into a stable oxide. It can be seen from thermodynamic stability diagrams that aluminum, silicon, manganese and chrome are oxidized even at very low oxygen pressures and will therefore form an oxidation layer in atmospheres with a low oxygen content. The oxygen pressures required in order to form oxide layers on iron and nickel are higher by approximately several powers of 10. The oxidation process leads to a sharp decline in the concentration of the chrome share in the metal matrix in the direction of the border with the oxide phase, which in turn results in diffusion of chrome from the deeper layers of the metal matrix toward the border area and in the oxidation reaction that takes place there.

Because of these physical and chemical processes in the metal matrix, the border areas that form between the individual phases, the individual oxide phases and the external atmosphere during thermal treatment, chrome is transported to an intensified extent, compared to the other components of the alloy, from the layers of the metal matrix near the surface toward the scale layers that are forming. As a result, the concentration of the alloy element chrome declines in the layers of the basic metal matrix near the surface, underneath the mixed oxide layer that has formed. This effect is known as chrome depletion. The layers of the basic metal matrix near the surface where this effect has occurred are known as the chrome-depleted zone of the metal matrix.

As long as the mixed oxide layer remains continuously intact, further oxidation of the metal matrix takes place very slowly; however, if this protective layer is broken through, oxidation of the underlying metal matrix proceeds very quickly. A "healing" mixed oxide layer forms at this location only when the chrome content of the underlying metal does not fall below a certain concentration (approximately 18.5% at a temperature of approximately 700° C.; approximately 15.5% at a temperature of approximately 1,000° C.). If a "healing" mixed oxide layer cannot form at the break-through points, then oxidation occurs during the further course of the process, resulting in the formation of $(Fe,Cr)_3O_4$ spinell structures. These spinell structures constitute a poorer diffusion barrier than the aforementioned mixed oxide layer. Under otherwise identical conditions, the oxidation rate increases between approximately 16% and 8% Cr by approximately four powers of 10.

If no stable and continuous mixed oxide layer with properties that protect against further oxidation is able to form at the start of high-temperature oxidation of the materials in question, due to an inadequate free oxygen share in the annealing atmosphere or an excessively low chrome content in the alloy, then a layer of $(Fe,Cr)_3O_4$ spinells forms initially on the metal surfaces. Thereafter, Fe ions diffuse relatively quickly through the spinell layer and are oxidated at the oxide/gas border area into the iron oxides wustite FeO, magnetite $Fe_3O_4$ and haematite $Fe_2O_3$. In this way, a scale layer forms that consists of two layers: an inner layer of Fe—Cr oxide and an outer layer of Fe oxide. The formation of this distinctive double structure can be explained by the much greater mobility of Fe compared to Cr in the Fe—Cr oxide layer, which means that, compared to Fe, only very little Cr is able to pass through the Fe—Cr oxide layer under the given conditions. For this reason, almost pure Fe oxide forms in the outer scale layers. The relative mobility of the individual alloy metals in the spinell layer can be represented by the following sequence:

$$Mn^{2+}>Fe^{2+}>Co^{2+}>Ni^{2+}>Cr^{2+}$$

Under such conditions, the oxidation of the metal is not prevented by a protective layer and continues without interruption.

If a $(Cr,Fe)_2O_3$ layer that protects against further oxidation of the metal matrix forms because of the annealing conditions, and particularly because of the free oxygen partial pressure in the annealing atmosphere and the adequate chrome share in the metal alloy, then the scale thickness will be in the range of approximately 1.0 $\mu$m. Under these conditions, the scale thicknesses depends only slightly on the annealing time. The scale consists essentially of mixed oxide $(Cr,Fe)_2O_3$. If this mixed oxide layer cannot form or is defective, further oxidation of the underlying material occurs.

If, under the given conditions, the chrome share in this material is sufficient for the formation of mixed oxide, a "healing" mixed oxide layer will form, which protects against further oxidation. In this case, the scale thicknesses are in the range of approximately several $\mu$m and depend on the degree of the defects. Once again, the scale consists largely of mixed oxide $(Cr,Fe)_2O_3$.

However, if the aforementioned chrome share is not present in the metal alloy or if the aforementioned mixed oxide layer cannot form due to the annealing conditions (free oxygen partial pressure in the annealing atmosphere is too low), then the oxidation of the metal proceeds continuously. Essentially, $(Fe,Cr)_3O_4$ spinell structures form initially, and very thick iron oxide layers form secondarily. The scale thickness is a function of the annealing time and can range from approximately several $10^1$ $\mu$m to $10^3$ $\mu$m.

If slabs of stainless steel are heated to temperatures of approximately 1,200° to 1,250° C. in, for example, pusher-type furnaces or walking-beam furnaces, a stable and continuous mixed oxide layer cannot form under the given conditions. Rather, a $(Fe,Cr)_3O_4$ spinell layer develops on the phase border with the metal, and above this forms a cover layer of iron oxide. This oxide layer (scale) has a thickness of approximately several millimeters. Before entering the first roll stand, the scale layer is sprayed off in a scale washer with high-pressure water of approximately 100 to 200 bar. Any scale that remains on the slab is pressed into the material surface during rolling and leaves scale scars, which result in rejection of the finished product. During the hot rolling, however, new scale forms in an ongoing fashion, which often begins breaking down under the mechanical stresses of the rolling process and is sprayed repeatedly with high-pressure water in front of and between the stands of a hot broadband train. The strip emerges from the last stand of the finishing roll line at a temperature of approximately 900° to 1,000° C., and the surface is covered by a very thin oxide layer of less than approximately 1 μm).

During subsequent cooling of the strip in the cooling line and the coiling device and as a wound coil, the scale layer grows to a thickness of approximately 5 to 10 μm. The scale consists of $(Fe,Cr)_3O_4$ spinell on the phase border with the metal and of a cover layer of iron oxide. Above approximately 560° C., the iron oxide consists largely of wustite FeO; at lower temperatures, the wustite decomposes into magnetite $Fe_3O_4$ and intercalated iron particles. Furthermore, it is possible under stronger oxidating conditions for a cover layer of haematite $F_2O_3$ to form, preferably on the strip edges as well as on the outer and inner windings of the coil. During cooling, cracks develop in the scale.

The chrome-depleted zone on the strip surface has a thickness of approximately less than 1 μm; the Cr-rich scale layer has a thickness of approximately 2 μm. As the coiling temperature drops, the thicknesses of the Cr-rich scale layer and of the Cr-depleted layer on the metal surface decrease.

If a surface covered with hot-rolled scale of this type is subjected to long-term annealing (greater than approximately 20 hours) in a hood-type annealing furnace, diffusion processes lead to an enlargement of the Cr-rich spinell layer on the phase border with the metal as well as to marked Cr depletion on the surface of the metal. The thickness of the spinell layer is approximately 3 μm and the Cr content is distinctly higher than it was before the annealing treatment. The Cr-depleted zone can be up to approximately 5 μm wide. The total scale layer has a thickness of approximately 10 to 15 μm. Frequently, a thin layer of iron (reduced iron oxide) lies on the oxide layer.

If the hot strip is annealed in the continuous furnace of an annealing pickling line at annealing times of a few minutes and at controllable oxygen partial pressure, the total scale layer thickness increases to approximately 10 to 15 μm. However, because of the brief annealing times, Cr-depletion can occur to only a slight extent, so that the Cr-depleted zone has a thickness of approximately 2 μm and the level of Cr-enrichment in the oxide layer on the phase border with the matrix metal is also lower. In respect to the removal of such annealing scale layers from hot strip, it should be noted that these layers do not carry any continuous mixed oxide layer like those found in the case of correspondingly annealed cold strip. The scale layers are therefore also thicker than comparable scale layers on cold strip by a factor of approximately 10.

The scale surface of hot strip annealed in this manner displays a high share of iron oxides with intercalated Cr-rich oxides. Given this surface share of iron oxides, the chemically highly-stable mixed oxide layer would be pervious to a pickling process to remove the scale cover by acid at an economical pickling rate by means of electrolytic combination with the chrome-depleted zone or the basic matrix, to form the local element with the scale layers necessary for chemical pickling and thus to achieve the potential for quick dissolution of the chrome-depleted zone or of the basic matrix in the acid with the accompanying subsurface and split-off mechanism for the oxide layers. However, oxides dissolve very slowly in acids and thus the aforementioned local element is established very slowly, so that economical pickling rates cannot be attained in the case of such hot strip scale in acid. It is therefore preferable to remove scale layers of this type from such surfaces by means of physical processes, such as blasting and/or brushing to such an extent that an adequate free area of the chrome-depleted layer or the basic matrix is uncovered to achieve economical pickling rates.

In the mechanical descaling process that follows the annealing of hot strip, typically not only the critical portion, but in fact a larger area, of the chrome-depleted layer or the basic matrix is uncovered. This is especially true because the chrome-depleted layer is less distinctive than in the case of cold strip, and the thickness of this layer is therefore not very great. It is thus possible to pickle at high pickling rates, given a suitable choice of concentration of the individual components in the mixed acid.

The annealing of hot strip is carried out in order to achieve recrystallization of the metal microstructure after hot rolling and cooling. This is equivalent to eliminating the increase in strength values that results from the hot rolling and cooling. However; in materials of AISI Series 300, as well as in approximately 80% of the materials of AISI Series 400, the increase in strength values is only approximately 10 to 20%. Approximately 50 to 80% of these materials could be cold-formed without an annealing process. The remaining approximately 20% of the materials of AISI Series 400, however, must be annealed prior to cold-forming.

Heretofore, in order to accommodate the aforementioned technical facts, hot strip treatment for all materials have used the following treatment steps:

annealing blasting pickling in oxidizing acids, sometimes with upstream electrolytic pickling (however, effectiveness with blasted material is only approximately 20 to 30%)

Thereafter, cold forming is performed in reverse rolling mills comprising up to approximately 13 roll passes, in order to produce cold strip with the desired finished thickness. When hot strip is desired as the end product, this plant configuration produces strip with a roughness grade of approximately 4–6 Ra μm.

In addition, heretofore, cold strip treatment was carried out based on material quality and forming degree in one or two passes through a cold-strip annealing and pickling line with the following treatment steps:

annealing electrolytic pickling pickling in oxidizing acids

In previous practice as a whole, significant disadvantages arise related to the following material-specific, economic and ecological parameters:

1. Hot strip in the form of a pickled end product is produced with a surface roughness of approximately 4–6 Ra μm.
2. Cold strip is produced in three independent process steps:
   annealing and pickling of hot strip
   cold forming
   annealing and pickling of cold strip Thus, resulting in high energy, personnel and transport costs and high levels of environmental pollution.

In order to partially reduce the aforementioned disadvantages, processes have already been developed that permit the sequential processing of hot strip to finished cold strip in a single line. In this case, the following process steps are used in a production line:

mechanical descaling of hot strip (non-annealed or annealed)

cold rolling in approximately 2 to 5 stands annealing pickling

The disadvantage of this configuration is that it is not possible to achieve approximately 100% removal of scale by means of mechanical descaling. Furthermore, as in the past, pickled hot strip with high surface roughness values is produced. The most important condition required for optimum surface quality of cold strip, namely, the approximate 100% removal of scale so that flawless surfaces can be produced in the cold-rolling step that follows, cannot be maintained.

SUMMARY OF THE INVENTION

An object of the present invention is to provide a process and an apparatus capable of economically producing rust-free hot strip (rust-free AISI Series 300 and 400) pickled in a single line, even in the case of material qualities requiring annealing of the hot strip prior to further treatment, e.g. ferrite 430, and having a surface roughness of only approximately 1 to 2 Ra $\mu$m.

A still further object of the invention is to provide a process and apparatus capable of producing rust-free hot strip (rust-free AISI Series 300 and 400) pickled in a single passage, to descale the hot strip approximately 100%; to reduce its thickness approximately 50 to 80%, depending on the rolling process; and to anneal, descale and dress the hot strip.

Another object of the invention is to provide a process and apparatus capable of producing rust-free hot strip (rust-free AISI Series 300 and 400) that ensures that the strip that is approximately 100% scale-free prior to cold forming has a passive layer, in order to guarantee that a reflection factor is reduced significantly by means of a dark coloring of the surface.

A further advantage of the process and the descaling apparatus according to the invention is found in the reflection factor of the descaled strip. It is known that cold-rolled rust-free steel strips have a high reflection factor, which requires higher energy and apparatus-related expenditure during the subsequent annealing. For this reason, it is economically advantageous to design the descaling unit in such a way that the strip is approximately 100% scale-free prior to cold forming, but nonetheless has a passive layer. This passive layer should have a maximum layer thickness of approximately 100 nanometers, so that no surface defects are produced during cold rolling, while a sufficient dark coloring of the surface is nonetheless ensured in order to significantly reduce the reflection factor.

The invention makes it possible to ensure approximately 100% descaling of hot strip prior to cold forming, while not increasing the surface roughness of the strip or, insofar as the necessary descaling process has increased the surface roughness of the strip, while decreasing the surface roughness. This is especially important for the material qualities which require annealing as hot strip prior to further treatment, e.g. ferrite 430. Heretofore, it has not been possible to economically remove the scale that develops in such a case by means of pickling. In order to remove the scale by mechanical devices, such as blasters, brushes, grinding powders, etc., an adequate free area must be uncovered on the chrome-depleted layer or the basic matrix. Until now, blasting the strip surface has been the most effective and economical solution in such cases. However, blasting the strip surface has the deleterious effect of increasing surface roughness up to approximately 6 Ra $\mu$m. The process and apparatus according to the invention offers the technical possibility, even for such materials, of reducing the surface roughness to approximately 1 to 2 Ra $\mu$m while using abrasive brushing.

The invention takes into account these considerations and provides a multifunctional technological unit with the following performance characteristics:

1. Approximately 100% descaling of non-annealed hot strip as well as annealed hot strip of all materials in the rust-free AISI Series 300 and 400.
2. Approximately 100% descaling of non-annealed hot strip by means of blasting, without any increase in the surface roughness of the hot strip.
3. Approximately 100% descaling of annealed hot strip by means of abrasive brushing, with the option of reducing the surface roughness of the strip that was increased by the blasting device.
4. Providing all strips with a passive layer that does not interfere with the subsequent rolling process but does color the surface of the hot strip, which has been freed of all oxide, in such a way that the reflection factor of the strip is significantly reduced.

To attain these objects, two processes have been developed, one for annealed and one for non-annealed hot strip. The descaling unit configuration differs from previous arrangements by incorporating the completely novel concept of electrolytic pickling. In accordance with the invention, first, the hot strip is stretched, bent and straightened to break a scale which has grown on the hot strip. Then, a electrolytic pickling is performed in an electrolyte with multiple alternating anodically-connected and cathodically-connected strip polarization. Directly following thereafter, pickling once again takes place in the electrolyte or in another electrolyte with multiple anodically-connected electrodes arranged directly behind one another and corresponding cathodic strip polarization, followed by anodic strip polarization produced by means of a cathodically-connected electrode. To further remove any scale remaining on the surface of the hot strip, the hot strip is subject to high-pressure fluid spraying or brush aggregates. Renewed electrolytic pickling in performed with at least one electrolyte with multiple exclusively cathodically-connected electrodes and anodic strip polarization. Finally, post-treatments are performed such as washing, brushing, post-washing and drying of the strip surface.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which is illustrated and described the invention.

BRIEF DESCRIPTION OF THE DRAWING

In the drawing:

The FIGURE diagrammatically depicts the descaling unit in accordance with the invention.

DETAILED DESCRIPTION OF THE PRESENTLY PREFERRED EMBODIMENTS

Figure 1A:
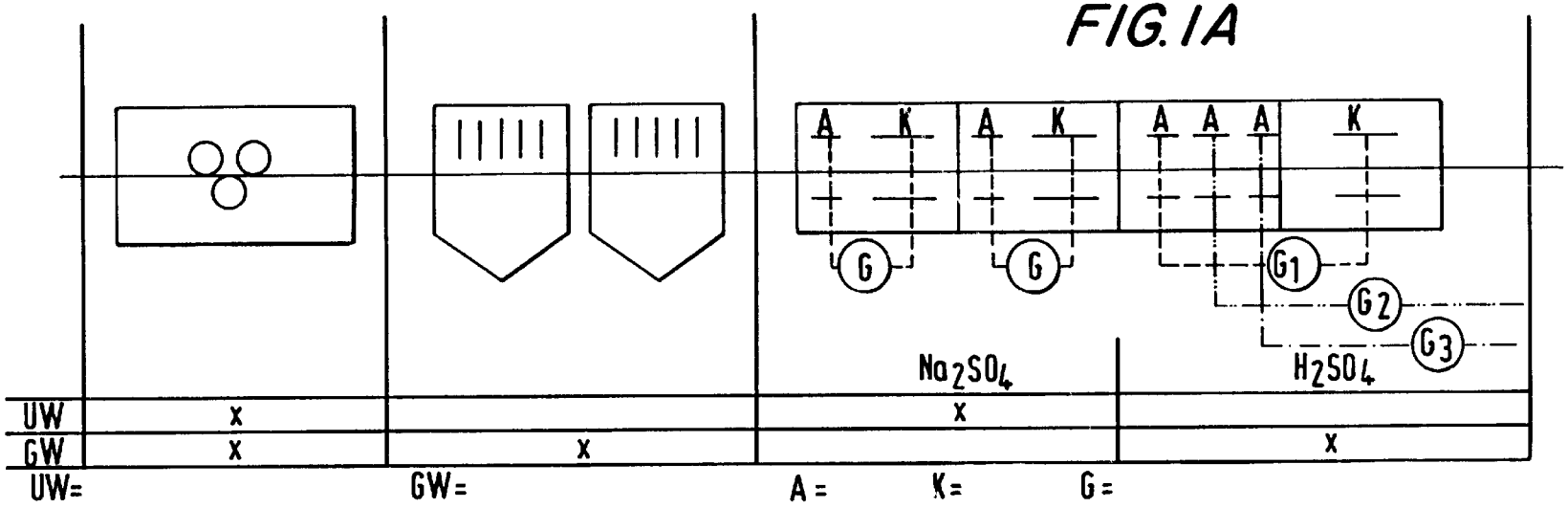
Figure 1B:
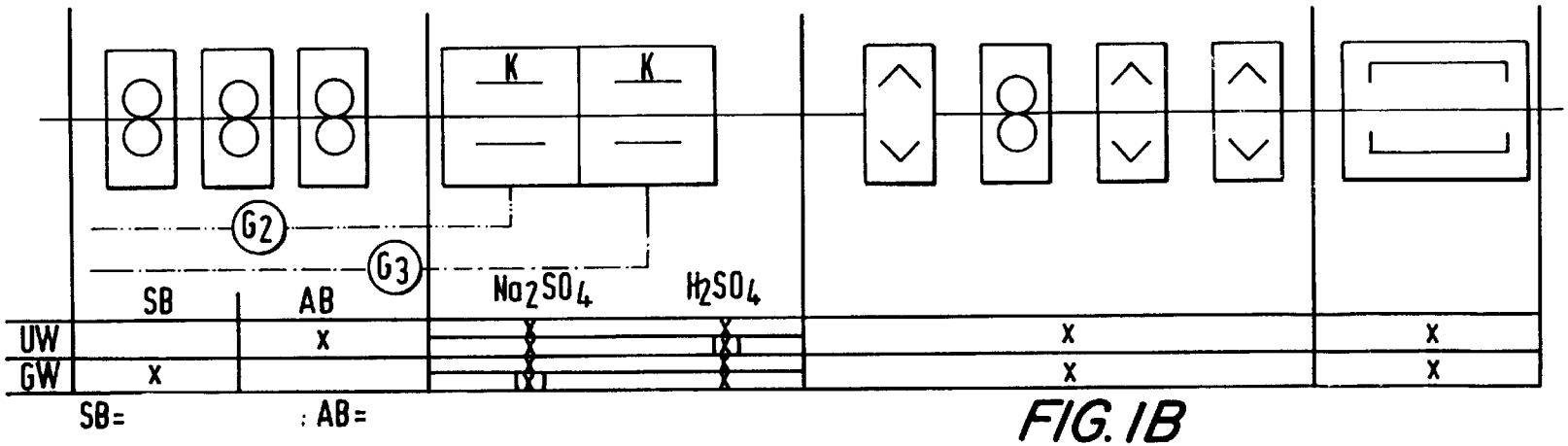

Referring to the FIGURE, the descaling unit consists of an aggregate that functions as a scale breaker and stretchleveller, in order, in the case of all materials, to permit or ease scale removal by the aggregates that follow and in order to produce a substantially planar strip. Thereafter, blasters are provided (depending on the strip rate: 1 to n aggregates), in order, in the case of annealed hot strip, to produce the free oxide areas required for the quick formation of the necessary potential for economical pickling. Electrolytic pickling that follows makes it possible to work, in cells according to the known system of electrolytic pickling, with a current flow connection of anode length approximately one-third (⅓) and cathode length approximately two-thirds (⅔). The number (n) of cells is based on the strip passage speed. Downstream from these cells, a cell containing more than two anodes is installed as the current feeder. Even further downstream is a cell that contains only one cathode which is connected via a rectifier to one of the anodes from the anode cell.

After the anodically-connected cell is a high-pressure fluid spray or brush aggregates, which function as follows:

1. In the case of non-annealed hot strip: to remove the scale oxidized and loosened during the electrolytic pickling portion; or
2. In the case of annealed hot strip, in addition, to reduce the higher strip surface roughness that was produced by blasting.

Tests have shown that using such technology, at this stage, the strip is not yet free of scale, as is desirable for cold forming or for optimum surface quality in annealed and pickled hot strip. To achieve this end, further post-treatment processing is needed after the abrasive surface cleaning. Thus, according to the invention, two electrolytic pickling cells with cathodic-connections carry out the final cleaning (substantially 100% removal of the remaining scale).

The technology of this arrangement and of the process according to the invention is based on the following facts:

Below the anode, the strip is cathodic, and thus necessarily has a pH-value of approximately 14 on its surface; this means that only gas development is effective here as a split-off factor for descaling. On the cathodic side, however, the strip is anodic, so that a pH-value of approximately 0 is established on the strip surface. This corresponds on the strip to a 1-molar $H_2SO_4$. Only this section of electrolytic pickling is also able to ensure pore-deep descaling.

For the material portion treated as annealed hot strip, the entire electrolytic part is carried out with a 3-molar $H_2SO_4$ as the electrolyte, instead of with or in addition to $Na_2SO_4$, in order to increase the gradients of the descaling effect.

It is important that the use of a 3-molar $H_2SO_4$ forms a dark-colored passive layer, along with pore-deep residual descaling, only in the cells arranged after the abrasive devices. The thickness of the passive layer is approximately 50 to 100 nm. The passive layer does not interfere with the rolling process in respect to the surface quality of the strip. However, it has a positive influence on the reflection factor for annealing.

The invention is not limited by the embodiments described above which are presented as examples only but can be modified in various ways within the scope of protection defined by the appended patent claims.

We claim:

1. A process for continuous treatment of a non-annealed hot strip of stainless steel in a descaling unit, comprising the following steps:

a) breaking a scale by stretching, bending and straightening of the non-annealed hot strip;

b) electrolytic pickling in an electrolyte with multiple alternating anodically-connected and cathodically-connected strip polarization;

c) pickling in an electrolyte with multiple anodically-connected electrodes arranged directly behind one another and corresponding cathodic strip polarization, followed by anodic strip polarization produced by means of a cathodically-connected electrode;

d) abrasively treating a surface of the hot strip;

e) renewed electrolytic pickling in an electrolyte with multiple exclusively cathodically-connected electrodes and anodic strip polarization; and f) post-treating the surface of the hot strip.

2. The process for continuous treatment of a non-annealed hot strip of stainless steel in claim 1, wherein said non-annealed hot strip of stainless steel contains one of high alloy shares of chrome of AISI Series 300 and 400.

3. The process for continuous treatment of a non-annealed hot strip of stainless steel in claim 2, wherein said process step d) is performed by high-pressure spraying of a fluid.

4. The process for continuous treatment of a non-annealed hot strip of stainless steel in claim 3, wherein the fluid is one of water or electrolyte.

5. The process for continuous treatment of non-annealed hot strip of stainless steel in claim 1, wherein in said process steps b) and c) the electrolyte is $Na_2SO_4$.

6. The process for continuous treatment of a non-annealed hot strip of stainless steel in claim 1, wherein in said process step e) the electrolyte is at least one of $Na_2SO_4$ and $H_2SO_4$.

7. The process for continuous treatment of a non-annealed hot strip of stainless steel in claim 1, wherein said process step d) is performed by high-pressure spraying of a fluid.

8. The process for continuous treatment of a non-annealed hot strip of stainless steel in claim 7, wherein the fluid is one of water or electrolyte.

9. A process for continuous treatment of an annealed hot strip of stainless steel in a descaling unit, comprising the following steps:

a) breaking a scale by stretching, bending and straightening the annealed hot strip;

b) blasting a surface of the hot strip at least one time;

c) electrolytic pickling in an electrolyte with multiple alternately anodically-connected and cathodically-connected electrodes;

d) pickling in an electrolyte with multiple anodically-connected electrodes arranged directly one behind the other, followed by a cathodically-connected electrode;

e) polishing the surface of the hot strip;

f) renewed electrolytic pickling in at least one electrolyte with multiple exclusively cathodically-connected electrodes and anodic strip polarization; and g) post-treating of the surface of the hot strip.

10. The process for continuous treatment of an annealed hot strip of stainless steel in claim 9, wherein said annealed hot strip of stainless steel contains one of high alloy shares of chrome of AISI Series 300 and 400.

11. The process for continuous treatment of an annealed hot strip of stainless steel in claim 9, wherein in said process steps c) and d) the electrolyte is $H_2SO_4$.

12. The process for the continuous treatment of an annealed hot strip of stainless steel as in claim 9, wherein in said process step f) the at least one electrolyte is at least one of $Na_2SO_4$ and $H_2SO_4$.

13. An apparatus for the continuous treatment of a non-annealed hot strip of stainless steel in a descaling unit comprising:

a) means for breaking a scale by stretching, bending and straightening the hot strip;

b) means for electrolytic pickling, said electrolytic pickling means comprising an electrolyte pickling bath and n cells with alternating anodically-connected and cathodically-connected electrodes with a one-third anode length and a two-thirds cathode length;

d) means for pickling, said pickling means comprising one of the electrolyte or another electrolyte first pickling bath with at least one cell with more than two exclusively anodically-connected electrodes, followed by a cell containing only one cathodically-connected electrode connected via a rectifier to one of the anodically-connected electrodes;

e) means for roughing a surface of the hot strip;

f) means for renewed electrolytic pickling, said renewed electrolytic pickling means comprising a second pickling bath with at least one electrolyte with at least two exclusively cathodically-connected electrodes, which are connected to the anodically-connected electrodes of the first pickling bath via rectifiers; and g) means for post-treating the surface of the hot strip.

14. The apparatus for continuous treatment of a non-annealed hot strip of stainless steel of claim 13, wherein said non-annealed hot strip of stainless steel contains one of high alloy shares of chrome of AISI Series 300 and 400.

15. The apparatus for continuous treatment of a non-annealed hot strip of stainless steel as in claim 14, wherein said means for roughing the surface of the hot strip comprises a high-pressure fluid spraying device spraying one of water and electrolyte.

16. An apparatus for continuous treatment of an annealed hot strip of stainless steel in a descaling unit, comprising:

a) means for breaking a scale by stretching, bending and straightening the hot strip;

b) means for blasting a surface of the hot strip at least one time;

c) means for electrolytic pickling, said electrolytic pickling means comprising an electrolyte pickling bath and n cells with alternating anodically-connected and cathodically-connected electrodes with a one-third anode length and a two-thirds cathode length;

d) means for pickling, said pickling means comprising a first pickling bath comprising an electrolyte with at least one cell with more than two exclusively anodically-connected electrodes, followed by a cell containing only one cathodically-connected electrode connected via a rectifier to one of the anodically-connected electrodes;

e) means for polishing a surface of the hot strip;

f) means for renewed electrolytic pickling, said renewed electrolytic pickling means comprising a second pickling bath with at least one electrolyte with at least two exclusively cathodically-connected electrodes, which are connected to the anodically-connected electrodes of the first pickling bath via rectifiers; and g) means for post-treating of the surface of the hot strip.

17. The apparatus for continuous treatment of an annealed hot strip of stainless steel of claim 16, wherein said annealed hot strip of stainless steel contains one of high alloy shares of chrome of AISI Series 300 and 400.

* * * * *